US010859311B2

(12) United States Patent
Alexander et al.

(10) Patent No.: US 10,859,311 B2
(45) Date of Patent: Dec. 8, 2020

(54) FREEZABLE BEVERAGE DISPENSER ASSEMBLY

(71) Applicants: James Alexander, Lyndhurst, NJ (US); Johnny Vasquez, Lyndhurst, NJ (US)

(72) Inventors: James Alexander, Lyndhurst, NJ (US); Johnny Vasquez, Lyndhurst, NJ (US)

( * ) Notice: Subject to any disclaimer, the term of this patent is extended or adjusted under 35 U.S.C. 154(b) by 85 days.

(21) Appl. No.: 16/208,825

(22) Filed: Dec. 4, 2018

(65) Prior Publication Data

US 2020/0173720 A1 Jun. 4, 2020

(51) Int. Cl.
*F25D 31/00* (2006.01)
*F25D 3/08* (2006.01)

(52) U.S. Cl.
CPC ..... *F25D 31/002* (2013.01); *F25D 3/08* (2013.01); *F25D 2303/08222* (2013.01); *F25D 2331/811* (2013.01)

(58) Field of Classification Search
CPC ..... F25D 2331/811; F25D 2303/0831; F25D 2331/8041; F25D 2331/812; F25D 2331/80; F25D 2303/08222; F25D 3/06; F25D 3/08; B67D 3/0009
See application file for complete search history.

(56) References Cited

U.S. PATENT DOCUMENTS

| | | | | |
|---|---|---|---|---|
| 2,440,753 | A * | 5/1948 | Mock | F25C 1/24 62/398 |
| 2,716,871 | A * | 9/1955 | Brown | F25D 31/007 62/293 |
| 3,391,730 | A * | 7/1968 | Calhoun, Jr. | F25D 3/00 165/47 |
| 4,562,991 | A | 1/1986 | Wu | |
| 6,123,226 | A * | 9/2000 | Giattino | B67D 3/0029 222/144.5 |
| 6,187,230 | B1 | 2/2001 | Clarke | |
| 6,763,675 | B1 | 7/2004 | Fleeman | |
| 9,238,575 | B2 | 1/2016 | Guido | |
| 9,456,813 | B2 | 10/2016 | Obermiller | |
| 9,546,813 | B2 * | 1/2017 | Luther | F25D 31/002 |
| 2009/0115109 | A1 | 5/2009 | Albright | |
| 2010/0281909 | A1 | 11/2010 | Carpanzano | |
| 2017/0234610 | A1 * | 8/2017 | Jones | F25B 21/02 62/3.2 |

* cited by examiner

*Primary Examiner* — Cassey D Bauer

(57) ABSTRACT

A freezable beverage dispenser assembly for cooling alcohol as the alcohol is being poured includes a reservoir that is fillable with a freezable liquid. The reservoir is placed in a freezer thereby facilitating the freezable liquid to freeze into ice. Moreover, the reservoir is comprised of a thermally conductive material such that the reservoir is cooled by the ice. The reservoir has a top wall that is sloped downwardly and a channel is formed into the top wall. A beverage poured into the channel, and the beverage runs down the top wall for dispensing the beverage into a beverage container. The ice in the reservoir cools the beverage when the beverage is poured onto the channel.

6 Claims, 6 Drawing Sheets

FREEZABLE BEVERAGE DISPENSER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dispenser devices and more particularly pertains to a new dispenser device for cooling alcohol as the alcohol is being poured.

BRIEF SUMMARY OF THE INVENTION

An embodiment of the disclosure meets the needs presented above by generally comprising a reservoir that is fillable with a freezable liquid. The reservoir is placed in a freezer thereby facilitating the freezable liquid to freeze into ice. Moreover, the reservoir is comprised of a thermally conductive material such that the reservoir is cooled by the ice. The reservoir has a top wall that is sloped downwardly and a channel is formed into the top wall. A beverage poured into the channel, and the beverage runs down the top wall for dispensing the beverage into a beverage container. The ice in the reservoir cools the beverage when the beverage is poured onto the channel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
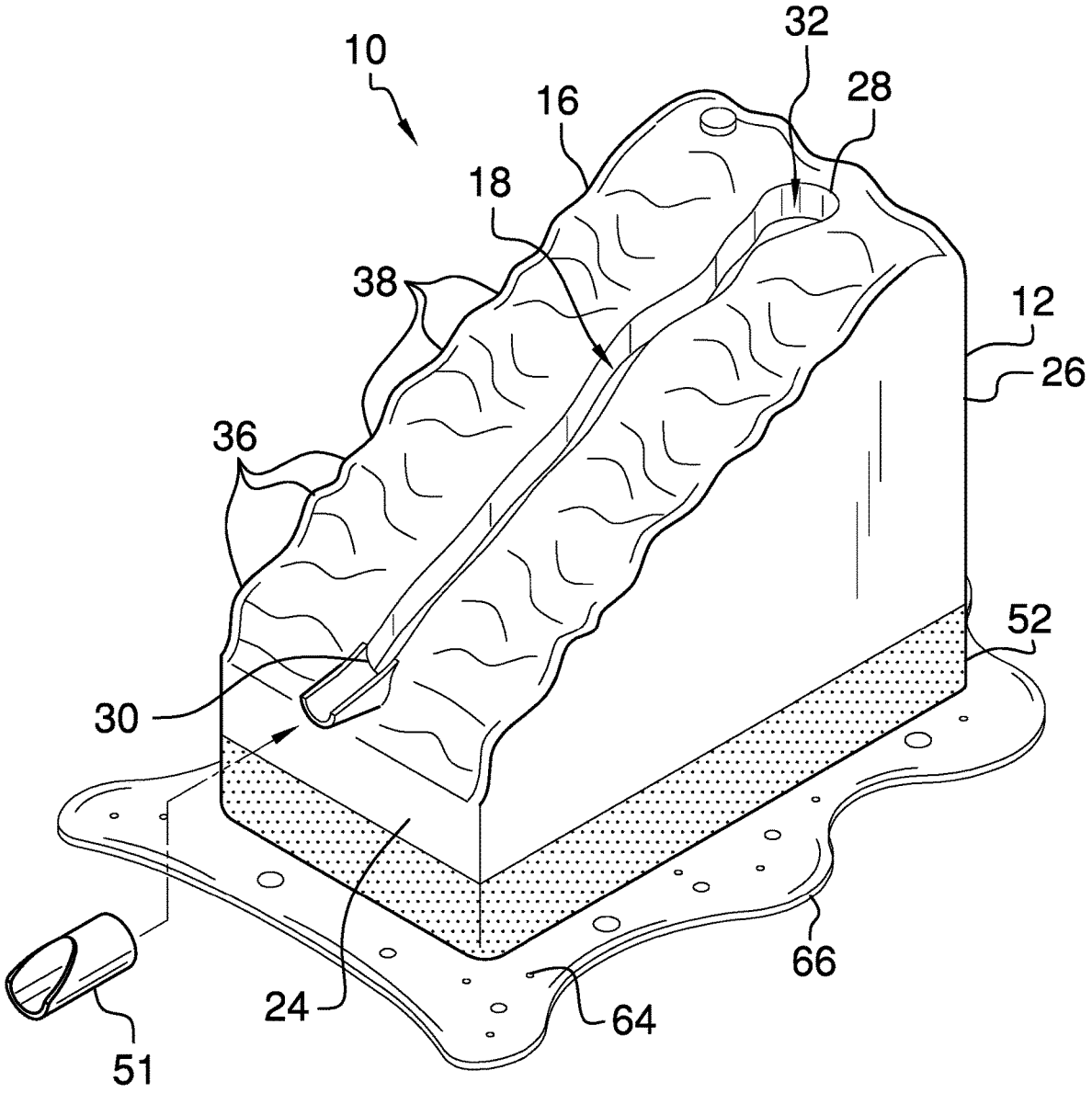
FIG. 1 is a top perspective view of a freezable beverage dispenser assembly according to an embodiment of the disclosure.
Figure 2:
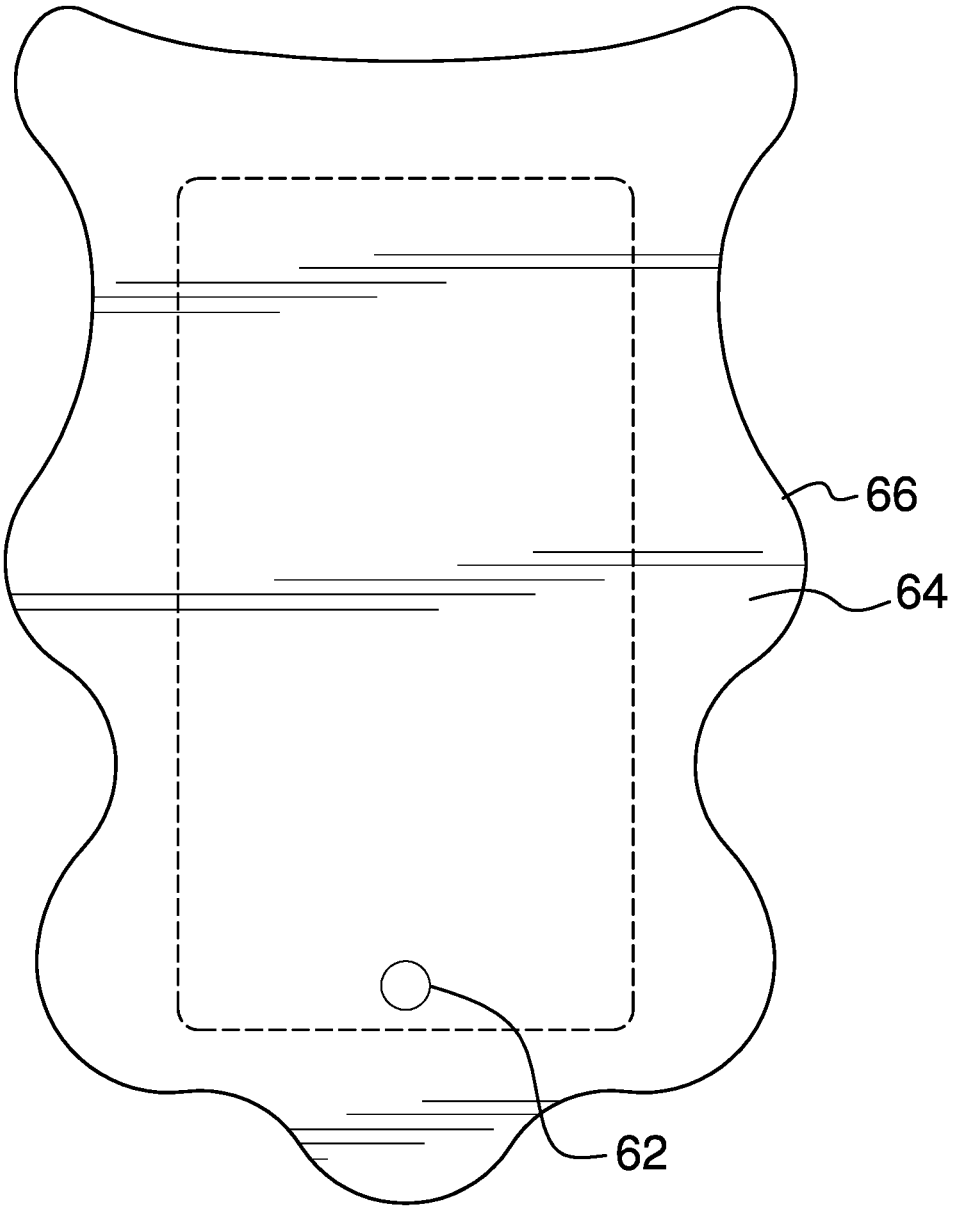
FIG. 2 is a bottom view of an embodiment of the disclosure.
Figure 3:
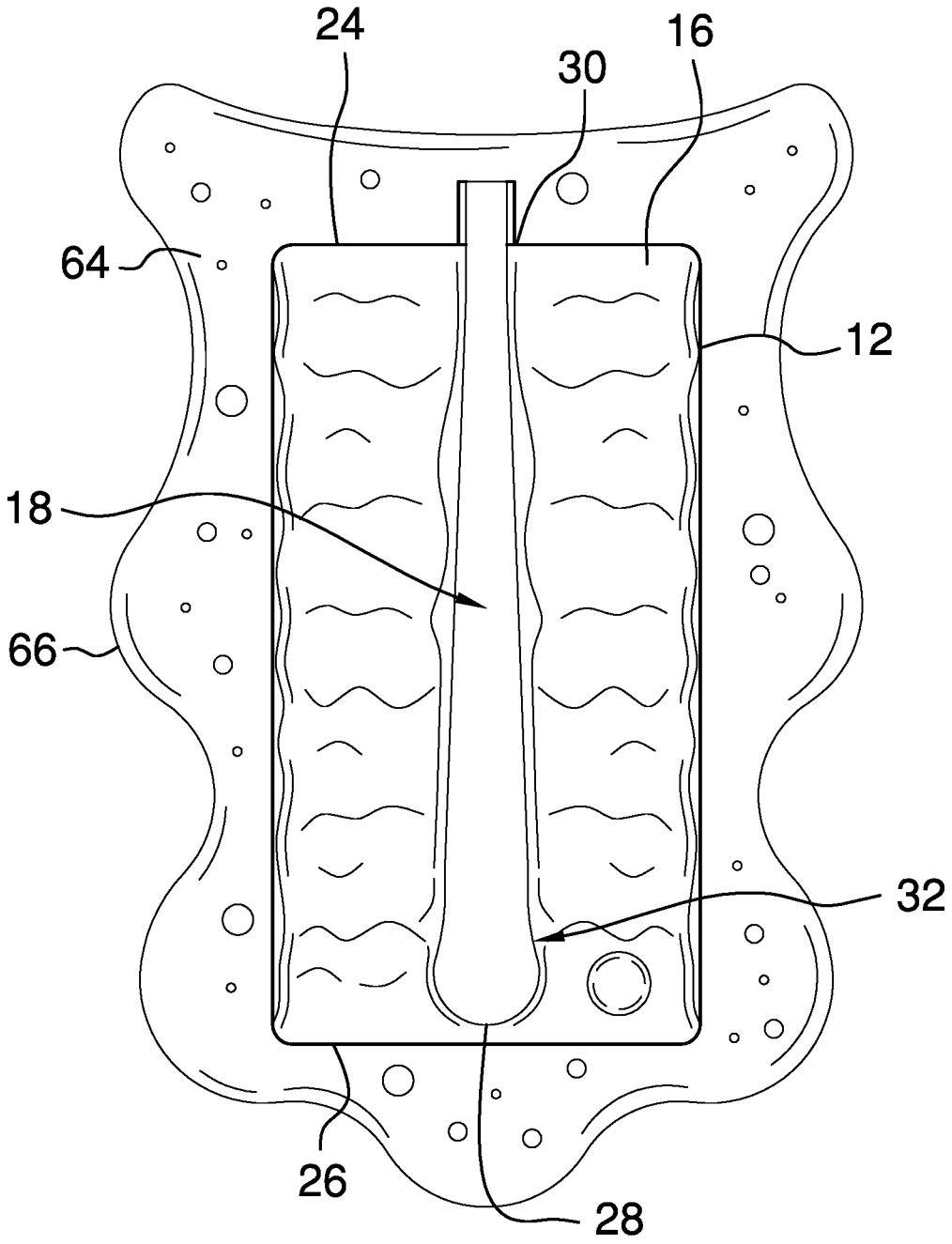
FIG. 3 is a top view of an embodiment of the disclosure.
Figure 4:
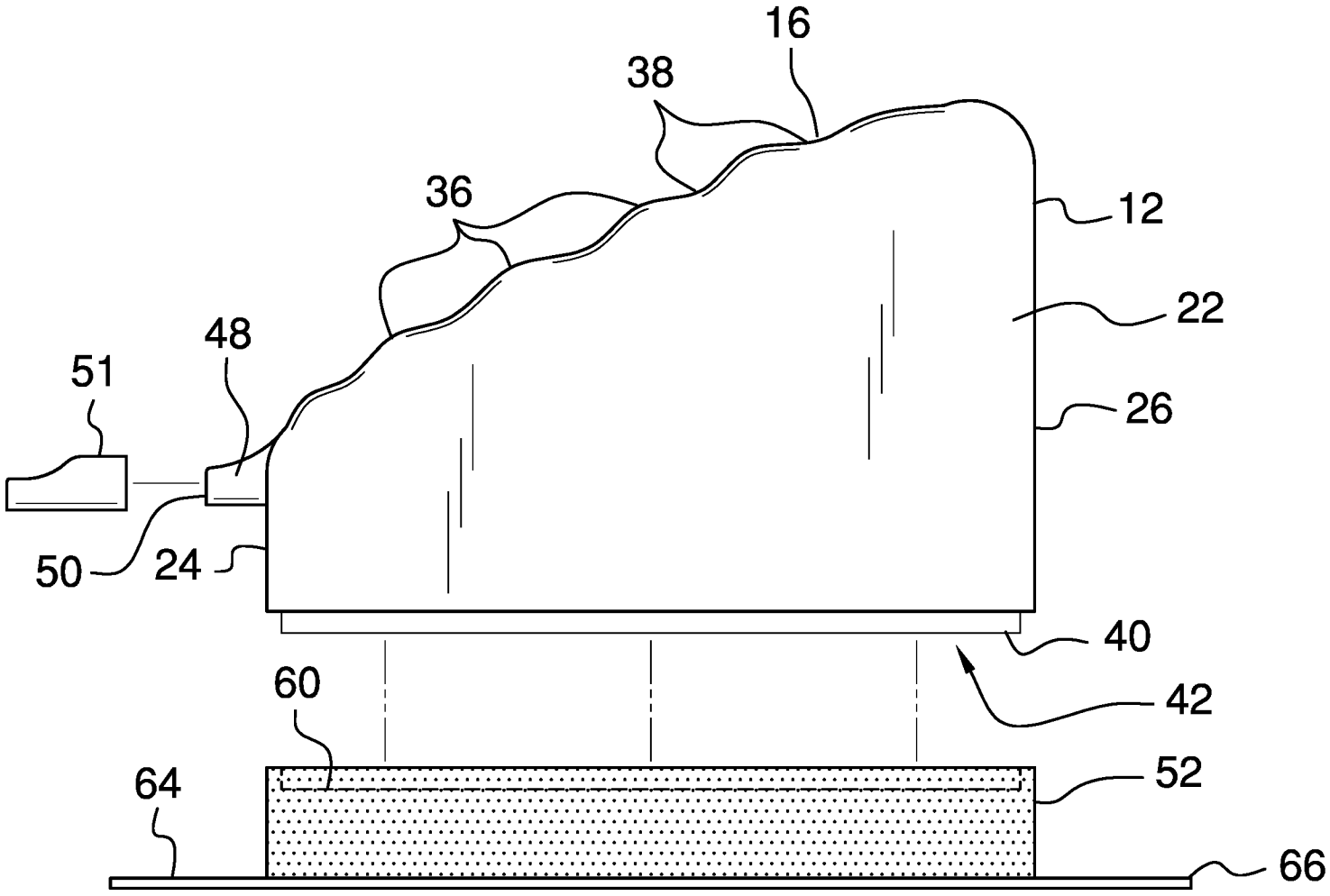
FIG. 4 is a left side exploded view of an embodiment of the disclosure.
Figure 5:
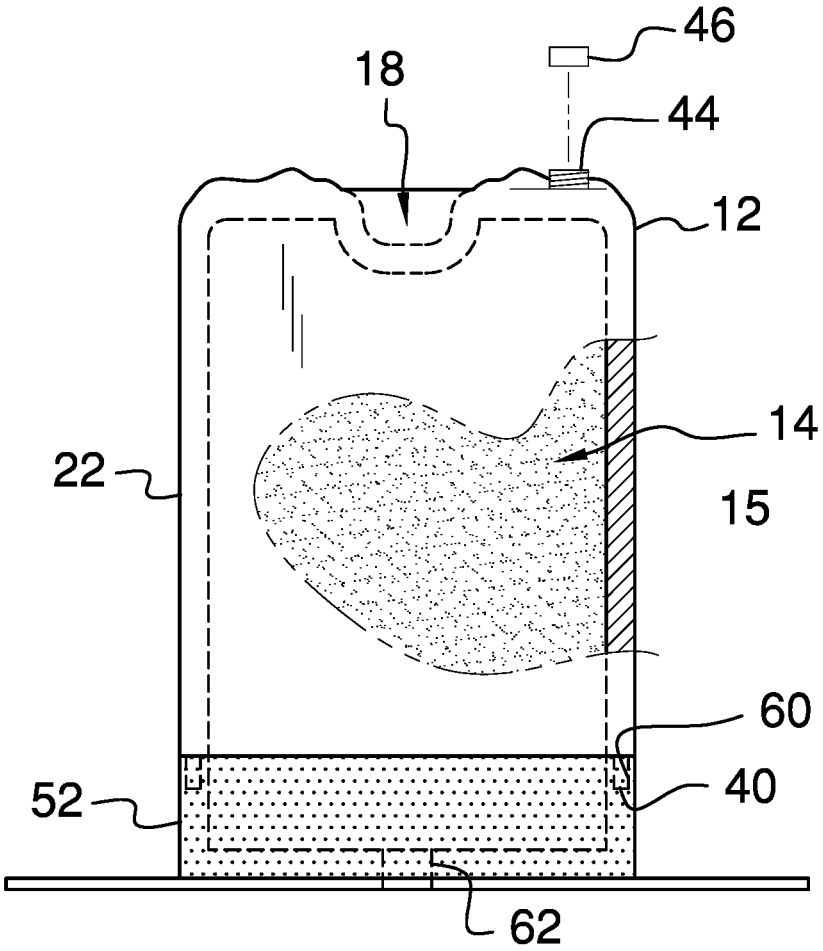
FIG. 5 is a back phantom cut-away view of an embodiment of the disclosure.
Figure 6:
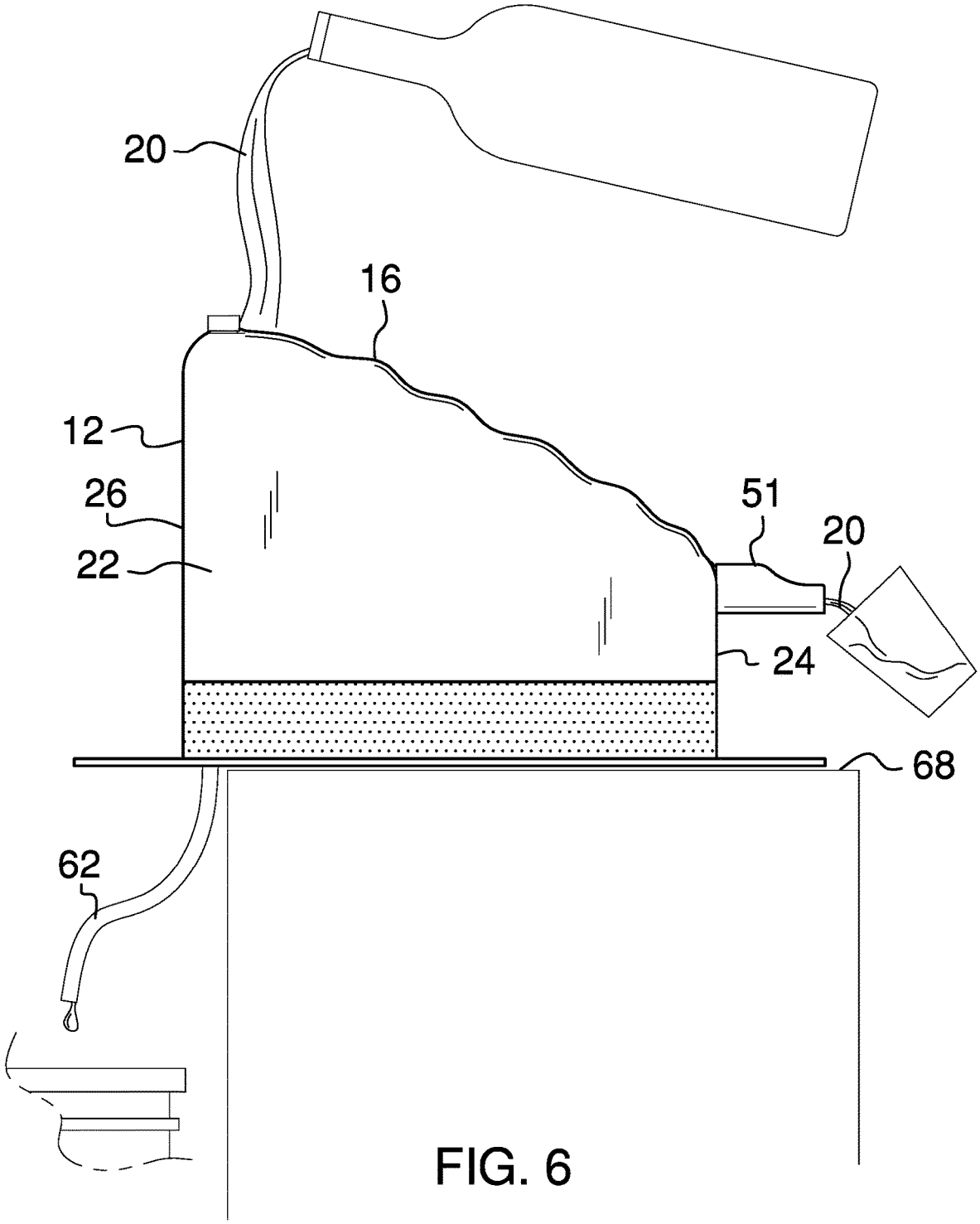
FIG. 6 is a perspective in-use view of an embodiment of the disclosure.

With reference now to the drawings, and in particular to FIGS. 1 through 6 thereof, a new dispenser device embodying the principles and concepts of an embodiment of the disclosure and generally designated by the reference numeral 10 will be described.

As best illustrated in FIGS. 1 through 6, the freezable beverage dispenser assembly 10 generally comprises a reservoir 12 that is filled with a freezable liquid 14 such as water. The reservoir 12 is placed in a freezer thereby facilitating the freezable liquid 14 to freeze into ice 15. Moreover, the reservoir 12 is comprised of a thermally conductive material such that the reservoir 12 is cooled by the ice 15. The reservoir 12 has a top wall 16 that is sloped downwardly and a channel 18 is formed in the top wall 16. A beverage 20, such as liquor, is poured onto the channel 18. Thus, the beverage 20 runs down the channel 18 to dispense the beverage 20 into a beverage container. Additionally, the ice 15 in the reservoir 12 cools the beverage 20 when the beverage 20 is poured onto the channel 18.

The reservoir 12 has an outer wall 22 extending downwardly from the top wall 16, and the outer wall 22 has a front side 24 and a back side 26. The top wall 16 slopes downwardly between the back side 26 and the front side 24, and the channel 18 has a first end 28 and a second end 30. The second end 30 of the channel 18 extends through the front side 24 of the outer wall 22 of the reservoir 12 to pour the beverage 20 outwardly therefrom. Additionally, the first end 28 of the channel 18 curves outwardly toward the back side 26 of the reservoir 12 to form a pool 32 for receiving the beverage 20. The reservoir 12 is comprised of a translucent material such that the ice 15 is visible through the reservoir 12. Additionally, the top wall 16 has an outer surface 34 and the outer surface 34 has a plurality of hills 36 and valleys 38 thereon. In this way the top wall 16 is structured to have the ornamental appearance of a top of a block of ice. The outer wall 22 of the reservoir 12 has a distal edge 40 with respect to the top wall 16 to define an opening 42 into the reservoir 12.

A fill spout 44 is fluidly coupled to the top wall 16 of the reservoir 12 for filling the reservoir 12 with the freezable liquid 14. A cap 46 or the like is removably coupled to the fill spout 44 for closing the fill spout 44. A pour spout 48 is coupled to and extends forwardly from the front side 24 of the outer wall 22 of the reservoir 12. The pour spout 48 has a distal end 50 with respect to the front side 24 and the distal end 50 is open. The pour spout 48 is aligned with the second end 30 of the channel 18 such that the pour spout 48 receives the beverage 20 when the beverage 20 is poured down the channel 18. The beverage container, such as a shot glass or the like, is positioned beneath the distal end 50 of the pour spout 48 for filling the beverage container with the beverage 20. A sleeve 51 is provided and the sleeve 51 is slidably positionable over the pour spout 48 to increase a length of the pour spout 48.

A base 52 is provided and the reservoir 12 is removably coupled to the base 52. The base 52 has an upper side 54, a lower side 56 and an outer side 58 extending therebetween, and the upper side 54 has a slot 60 extending toward the lower side 56. The slot 60 is coextensive with a perimeter of the upper side 54 and the slot 60 insertably receives the distal edge 40 of the outer wall 22 of the reservoir 12 when the reservoir 12 is positioned on the base 52. Additionally, the outer wall 22 of the reservoir 12 forms a fluid impermeable seal with the slot 60. In this way the base 52 inhibits the freezable liquid 14 from leaking outwardly from the reservoir 12. A drain 62 extends through the upper 54 and lower 56 sides of the base 52 to facilitate the freezable liquid 14 to drain out of the reservoir 12 when the freezable liquid 14 melts.

A panel 64 extends outwardly from the outer side 58 of the base 52, the panel 64 is aligned with the lower side 56 of the base 52 and the panel 64 is extends around an entire perimeter of the outer side 58. The panel 64 has a distal edge 66 with respect to the outer side 58 and the distal edge 66 has a plurality of undulating curves. Additionally, the panel 64 may have indicia printed thereon and the indicia may comprise images of air bubbles in a fluid. Thus, the panel 64 has the ornamental appearance of water resulting from melted ice or the like. The lower side 56 of the base 52 and the panel 64 rest on a support surface 68, such as a table or the like, when the base 52 is positioned on the support surface 68.

In use, the reservoir 12 is filled with the freezable fluid 14 and each of the base 52 and the reservoir 12 are positioned in the freezer to freeze the freezable fluid 14. The base 52 and the reservoir 12 are removed from the freezer and are each placed on a table or the like when alcoholic beverages are being served. The beverage 20, such as whiskey, cordials, vodka and any other distilled spirit or fermented beer is poured into the pool 32 defined by the first end 28 of the channel 18. The beverage 20 runs down the channel 18 and the ice 15 in the reservoir 12 cools the beverage 20 as the beverage 20 runs down the channel 18. Ultimately, the beverage 20 runs out of the distal end 50 of the pour spout 48 and into a shot glass or other beverage container that is positioned beneath the pour spout 48. The resilient construction of the reservoir 12 inhibits the channel 18 from eroding, melting and increasing in depth in the manner of a "shot luge" that is formed of solid ice. Moreover, the reservoir 12 may be refilled, refrozen and reused an unlimited number of times compared to a single use, solid ice "shot luge".

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A freezable beverage dispenser assembly being configured to have a beverage poured thereon thereby cooling the beverage while dispensing the beverage, said assembly comprising:

a reservoir being fillable with a freezable liquid, said reservoir being placed in a freezer thereby facilitating said freezable liquid to freeze into ice, said reservoir being comprised of a thermally conductive material such that said reservoir is cooled by said ice, said reservoir having a top wall being sloped downwardly and having a channel being formed therein, said channel having a beverage poured thereon wherein said top wall is configured to dispense the beverage into a beverage container, said ice in said reservoir cooling the beverage when the beverage is poured onto said channel, said reservoir having an outer wall extending downwardly from said top wall, said outer wall having a front side and a back side, said top wall sloping downwardly between said back side and said front side, said channel having a first end and a second end, said second end of said channel extending through said front side of said outer wall of said reservoir wherein said second end of said channel is configured to pour the beverage outwardly therefrom;

a base having said reservoir being removably coupled thereto;

a pour spout being coupled to and extending forwardly from said front side of said outer wall of said reservoir, said pour spout having a distal end with respect to said front side, said distal end being open, said pour spout being aligned with said second end of said channel wherein said pour spout is configured to receive the beverage when the beverage is poured down said channel; and a sleeve, said sleeve being slidably positionable over said pour spout.

2. The assembly according to claim 1, wherein said top wall has an outer surface, said outer surface having a plurality of hills and valleys thereon wherein said top side is configured to have the ornamental appearance of an icy slope, said outer wall of said reservoir having a distal edge with respect to said top wall to define an opening into said reservoir.

3. The assembly according to claim 1, further comprising a fill spout being fluidly coupled to said top wall of said reservoir for fill spouting said reservoir with said freezable liquid.

4. The assembly according to claim 2, wherein said base has an upper side and a lower side, said upper side having a slot extending toward said lower side, said slot being coextensive with a perimeter of said upper side.

5. The assembly according to claim 4, wherein said slot insertably receives said distal edge of said outer wall of said reservoir when said reservoir is positioned on said base, said outer wall forming a fluid impermeable seal with said slot wherein said base is configured to inhibit the beverage from leaking outwardly from said reservoir.

6. A freezable beverage dispenser assembly being configured to have a beverage poured thereon thereby cooling the beverage while dispensing the beverage, said assembly comprising:

a reservoir being fillable with a freezable liquid, said reservoir being placed in a freezer thereby facilitating said freezable liquid to freeze into ice, said reservoir being comprised of a thermally conductive material such that said reservoir is cooled by said ice, said reservoir having a top wall being sloped downwardly and having a channel being formed therein, said channel having a beverage poured thereon wherein said top wall is configured to dispense the beverage into a beverage container, said ice in said reservoir cooling the beverage when the beverage is poured onto said channel, said reservoir having an outer wall extending downwardly from said top wall, said outer wall having a front side and a back side, said top wall sloping downwardly between said back side and said front side, said channel having a first end and a second end, said second end of said channel extending through said front side of said outer wall of said reservoir wherein said second end of said channel is configured to pour the beverage outwardly therefrom, said top wall having an outer surface, said outer surface having a plurality of hills and valleys thereon wherein said top side is configured to have the ornamental appearance of an icy slope, said outer wall of said reservoir having a distal edge with respect to said top wall to define an opening into said reservoir;

a fill spout being fluidly coupled to said top wall of said reservoir for fill spouting said reservoir with said freezable liquid;

a pour spout being coupled to and extending forwardly from said front side of said outer wall of said reservoir, said pour spout having a distal end with respect to said front side, said distal end being open, said pour spout being aligned with said second end of said channel wherein said pour spout is configured to receive the beverage when the beverage is poured down said channel;

a sleeve, said sleeve being slidably positionable over said pour spout; and a base having said reservoir being removably coupled thereto, said base having an upper side and a lower side, said upper side having a slot extending toward said lower side, said slot being coextensive with a perimeter of said upper side, said slot insertably receiving said distal edge of said outer wall of said reservoir when said reservoir is positioned on said base, said outer wall forming a fluid impermeable seal with said slot wherein said base is configured to inhibit the beverage from leaking outwardly from said reservoir.

* * * * *